United States Patent [19]

Hulteen

[11] 4,129,954

[45] Dec. 19, 1978

[54] DISHWASHER INDICATING DEVICE

[76] Inventor: James M. Hulteen, Antelope Hill, Austin, Colo. 81410

[21] Appl. No.: 812,848

[22] Filed: Jul. 5, 1977

[51] Int. Cl.[2] ..... G09F 7/20

[52] U.S. Cl. ..... 40/607; 211/41; D7/188

[58] Field of Search ..... 40/145 R, 125 H, 125 F, 40/125 R, 10 C, 16.4, 607, 606; 134/113; 211/41; D7/188

[56] References Cited

U.S. PATENT DOCUMENTS

| | | | |
|---|---|---|---|
| 1,614,792 | 1/1927 | Joiner | 40/125 H X |
| 2,025,004 | 12/1935 | Shearer | 40/145 R |
| 3,296,725 | 1/1967 | Fenwick | 40/125 H X |
| 3,315,393 | 4/1967 | Louft | 40/145 R |
| 3,468,047 | 9/1969 | Beatty | 40/145 R X |

*Primary Examiner*—John F. Pitrelli
*Attorney, Agent, or Firm*—Daniel Jay Tick

[57] ABSTRACT

A sign member bearing alternate messages such as "DIRTY DISHES" and "CLEAN DISHES" is affixed to a support rod removably seated in the bore of a support member affixed to the rack of a dishwasher. The sign member indicates the status of the items in the dishwasher.

3 Claims, 4 Drawing Figures

DISHWASHER INDICATING DEVICE

BACKGROUND OF THE INVENTION

The present invention relates to a dishwasher indicating device.

The dishwasher indicating device of the invention consists of temperature-resistant plastic material and may use a multi-colored base for attractiveness. The multi-colored base may be of a red, white and blue configuration. The device of the invention is used to indicate whether dishes and other items in a dishwasher are clean or dirty, so that the user of the dishwasher may determine at a glance whether the dishes and items in a dishwasher are clean or dirty, so that the user of the dishwasher may determine at a glance whether the dishes and items are immediately available for use or must be washed. The device of the invention may also be used as a reusable business marker for advertising material and slogans such as, for example, "IT'S A BEAUTIFUL DAY" and "FEELING BAD", on opposite sides of the sign member.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
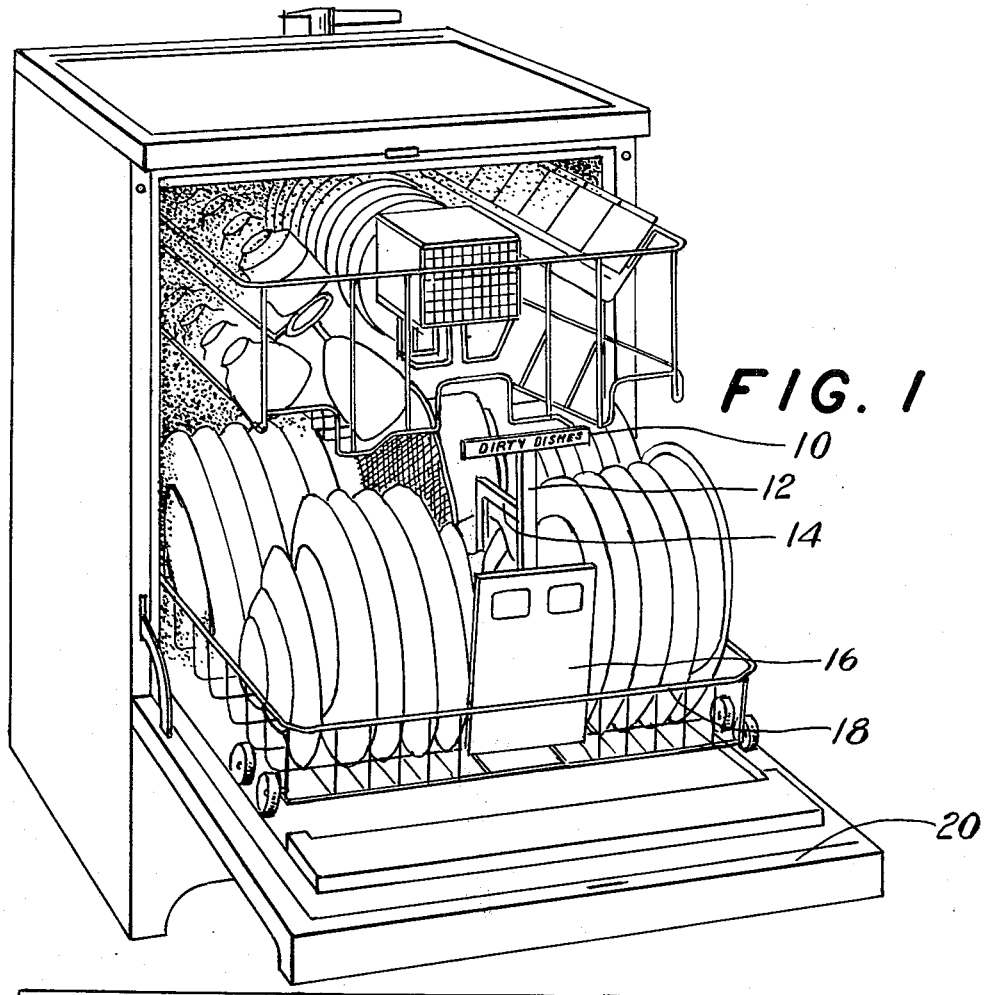
FIG. 1 is a view of an embodiment of the dishwasher indicating device of the invention, in use.

The dishwasher indicating device of the invention indicates the condition of items in a dishwasher. The dishwasher has a movably mounted rack 18 for supporting dishes, tableware, eating utensils, and the like to be washed, as shown in FIG. 1.

The dishwasher indicating device of the invention comprises a support member 12 (FIGS. 1 to 4) affixed to the rack 18 of the dishwasher and extending upright from said rack. The support member 12 comprises a substantially tubular member having an upper free end and an axial bore of substantially square cross-section formed therein at said upper free end.

Figures 2, 3, 4:
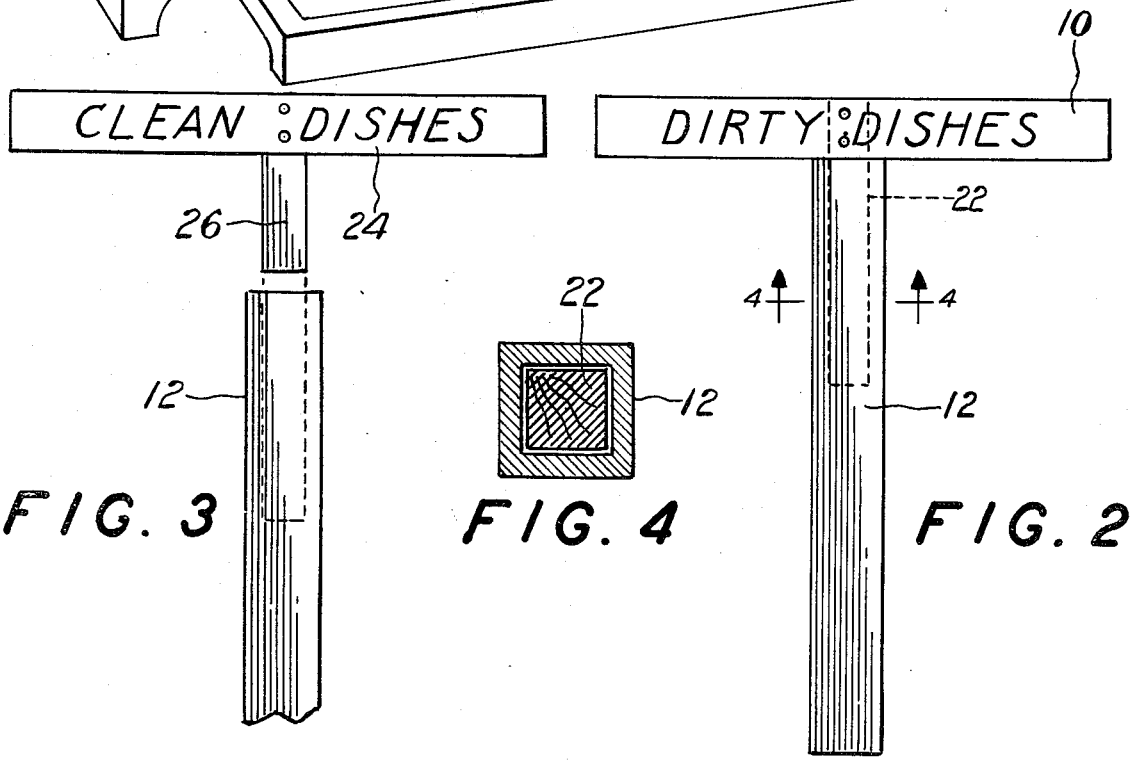
FIG. 2 is a view, on an enlarged scale, of the dishwasher indicating device of the invention, indicating dirty dishes.
FIG. 3 is a view, on an enlarged scale, of the dishwasher indicating device of the invention, indicating clean dishes.
FIG. 4 is a cross-sectional view, on an enlarged scale, taken along the lines 4—4, of FIG. 2.

An indicator has a support rod 22, 26 of substantially square cross-section with spaced opposite first and second ends. A sign member 10, 24 is affixed to the first end of the support rod 22, 26 and extends substantially perpendicularly with said support rod to form a T-shaped member. The second end of the support rod 22, 26 is removably seated in the bore of the support member 12, as shown in FIGS. 1, 2 and 4.

The sign member 10, 24 has a pair of spaced opposite surfaces 10 and 24, respectively. The surface 10 indicates that the items in the dishwasher are dirty, as shown in FIGS. 1 and 2, by having the words "DIRTY DISHES" thereon. The other surface 24 of the sign member 10, 24 indicates that the items in the dishwasher are clean, as shown in FIG. 3, by having the words "CLEAN DISHES" thereon.

The rack 18 of the dishwasher has a front and a back, and the support member 12 is affixed to the rack at the front thereof.

The sign member 10, 24, the rod 22, 26 and the support member 12 consist of temperature-resistant plastic material of any suitable type. The sign member 10, 24 is preferably a bright color and bears alphabetic characters of bright contrasting colors on its surfaces.

Having described a preferred embodiment of my invention, it is understood that various changes can be made without departing from the spirit of my invention, and, I desire to cover by the appended claims all such modifications as fall within the true spirit and scope of my invention.

What I claim and seek to secure by Letters Patent is:

1. A dishwasher indicating device for indicating the condition of items in a dishwasher, said dishwasher having a movably mounted rack for supporting dishes, tableware, eating utensils, and the like, to be washed, said dishwasher indicating device comprising a support member affixed to the rack of a dishwasher and extending upright from said rack, said support member comprising a substantially tubular member having an upper free end and an axial bore of substantially square cross-section formed therein at said upper free end; and an indicator having a support rod of substantially square cross-section with spaced opposite first and second ends and a sign member affixed to the first end of said support rod and extending substantially perpendicularly with said support rod to form a T-shaped member, the second end of said support rod being removably seated in the bore of said support member, said sign member having a pair of opposite surfaces, one of said surfaces indicating that the items in the dishwasher are dirty and the other of said surfaces indicating that the items in said dishwasher are clean.

2. A dishwasher indicating device as claimed in claim 1, wherein the rack of the dishwasher has a front and a back and said support member is affixed to said rack at the front thereof.

3. A dishwasher indicating device as claimed in claim 1, wherein the sign member and rod consist of temperature-resistant plastic material and the sign member is a bright color and bears alphabetic characters of bright contrasting colors on its surfaces.

* * * * *